US010634353B2

(12) United States Patent
Bennett et al.

(10) Patent No.: US 10,634,353 B2
(45) Date of Patent: Apr. 28, 2020

(54) FUEL NOZZLE ASSEMBLY WITH MICRO CHANNEL COOLING

(71) Applicant: General Electric Company, Schenectady, NY (US)

(72) Inventors: William Thomas Bennett, Danvers, MA (US); Jared Peter Buhler, Tewksbury, MA (US); Craig Alan Gonyou, Blanchester, OH (US)

(73) Assignee: General Electric Company, Schenectady, NY (US)

( * ) Notice: Subject to any disclaimer, the term of this patent is extended or adjusted under 35 U.S.C. 154(b) by 524 days.

(21) Appl. No.: 15/404,637

(22) Filed: Jan. 12, 2017

(65) Prior Publication Data

US 2018/0195725 A1 Jul. 12, 2018

(51) Int. Cl.
*F23R 3/28* (2006.01)
*F23R 3/04* (2006.01)

(52) U.S. Cl.
CPC ..... *F23R 3/283* (2013.01); *F23R 3/286* (2013.01); *F23R 3/04* (2013.01)

(58) Field of Classification Search
CPC ..... F23R 3/283; F23R 3/286; F23R 3/002; F23R 3/50; F23R 2900/03041–03043
See application file for complete search history.

(56) References Cited

U.S. PATENT DOCUMENTS 3,917,173 A 11/1975 Singh
4,085,581 A * 4/1978 Caruel ..... F23R 3/002 60/738
4,100,733 A 7/1978 Striebel et al.
4,177,637 A 12/1979 Pask
4,242,871 A 1/1981 Breton
4,365,470 A 12/1982 Matthews et al.
4,408,461 A 10/1983 Bruhwiler et al.
4,412,414 A 11/1983 Novick et al.
4,689,961 A 9/1987 Stratton
(Continued)

FOREIGN PATENT DOCUMENTS

CN 203147823 U 8/2013

OTHER PUBLICATIONS

International PCT Search Report Corresponding to Application No. PCT-US2017067760 dated Apr. 16, 2018.
(Continued)

*Primary Examiner* — Gerald L Sung
*Assistant Examiner* — Rene D Ford
(74) *Attorney, Agent, or Firm* — Dority & Manning, P.A.

(57) ABSTRACT

The present disclosure is directed to a fuel nozzle for a gas turbine engine, the fuel nozzle defining a radial direction, a longitudinal direction, a circumferential direction, an upstream end, and a downstream end. The fuel nozzle includes an aft body coupled to at least one fuel injector. The aft body defines a forward wall and an aft wall each extended in the radial direction, and a plurality of sidewalls extended in the longitudinal direction. The plurality of sidewalls couples the forward wall and the aft wall. The forward wall defines at least one channel inlet orifice. At least one sidewall defines at least one channel outlet orifice. At least one micro channel cooling circuit is defined between the one or more channel inlet orifices and the one or more channel outlet orifices.

20 Claims, 6 Drawing Sheets

(56) References Cited

U.S. PATENT DOCUMENTS 4,914,918 A 4/1990 Sullivan
4,967,561 A 11/1990 Bruhwiler et al.
5,142,871 A 9/1992 Lampes et al.
5,207,064 A 5/1993 Ciokajlo et al.
5,211,675 A 5/1993 Bardey et al.
5,253,471 A * 10/1993 Richardson ..... F23R 3/10 60/754
5,265,409 A 11/1993 Smith, Jr. et al.
5,307,634 A 5/1994 Hu
5,323,604 A * 6/1994 Ekstedt ..... F23R 3/34 60/747
5,417,069 A * 5/1995 Alary ..... F23R 3/04 60/747
5,511,375 A 4/1996 Joshi et al.
5,592,821 A 1/1997 Alary et al.
5,619,855 A 4/1997 Burrus
5,622,054 A 4/1997 Tingle
5,657,633 A * 8/1997 Brueggert ..... F23R 3/10 60/747
5,682,747 A * 11/1997 Brown ..... F23R 3/10 60/746
5,829,967 A 11/1998 Chyou
5,839,283 A 11/1998 Dobbeling
5,930,999 A * 8/1999 Howell ..... F23D 11/107 239/402
5,937,653 A 8/1999 Alary et al.
5,941,076 A 8/1999 Sandelis
5,956,955 A 9/1999 Schmid
5,974,805 A * 11/1999 Allen ..... F23R 3/002 60/740
6,038,861 A 3/2000 Amos et al.
6,286,298 B1 9/2001 Burrus et al.
6,295,801 B1 10/2001 Burrus et al.
6,298,667 B1 * 10/2001 Glynn ..... F23R 3/002 29/889.2
6,331,109 B1 12/2001 Paikert et al.
6,442,939 B1 9/2002 Stuttaford et al.
6,460,339 B2 10/2002 Nishida et al.
6,536,216 B2 * 3/2003 Halila ..... F01D 5/08 60/737
6,539,721 B2 4/2003 Oikawa et al.
6,539,724 B2 4/2003 Cornwell et al.
6,564,555 B2 5/2003 Rice et al.
6,594,999 B2 7/2003 Mandai et al.
6,598,584 B2 7/2003 Beck et al.
6,758,045 B2 * 7/2004 Dimov ..... F23R 3/002 60/747
6,772,594 B2 8/2004 Nishida et al.
6,837,050 B2 1/2005 Mandai et al.
6,837,051 B2 1/2005 Mandai et al.
6,871,501 B2 * 3/2005 Bibler ..... F23R 3/002 60/737
6,915,637 B2 7/2005 Nishida et al.
6,962,055 B2 11/2005 Chen et al.
7,008,185 B2 3/2006 Peterman et al.
7,036,482 B2 5/2006 Beck et al.
7,188,476 B2 3/2007 Inoue et al.
7,200,998 B2 4/2007 Inoue et al.
7,313,919 B2 1/2008 Inoue et al.
7,360,363 B2 4/2008 Mandai et al.
7,565,803 B2 7/2009 Li et al.
7,596,949 B2 * 10/2009 DeVane ..... F23R 3/002 60/748
7,677,026 B2 3/2010 Conete et al.
7,681,398 B2 3/2010 Patel et al.
7,770,397 B2 8/2010 Patel et al.
7,788,929 B2 9/2010 Biebel et al.
7,810,333 B2 10/2010 Kraemer et al.
7,966,801 B2 6/2011 Umeh et al.
8,112,999 B2 * 2/2012 Zuo ..... F23D 14/78 60/730
8,146,364 B2 4/2012 Johnson et al.
8,161,751 B2 4/2012 Hall
8,166,763 B2 * 5/2012 Piper ..... F23R 3/283 60/737
8,276,385 B2 10/2012 Zuo et al.
8,316,644 B2 11/2012 Wilbraham
8,322,143 B2 12/2012 Uhm et al.
8,365,533 B2 * 2/2013 Johnson ..... F02C 7/222 60/739
8,424,311 B2 4/2013 York et al.
8,499,566 B2 8/2013 Lacy et al.
8,511,087 B2 8/2013 Fox et al.
8,528,337 B2 9/2013 Berry et al.
8,539,773 B2 9/2013 Ziminsky et al.
8,590,311 B2 11/2013 Parsania et al.
8,621,870 B2 1/2014 Carroni et al.
8,671,691 B2 3/2014 Boardman et al.
8,701,417 B2 4/2014 Nicholls et al.
8,863,524 B2 10/2014 Karlsson et al.
8,938,971 B2 1/2015 Poyyapakkam et al.
8,943,835 B2 2/2015 Corsmeier et al.
9,080,458 B2 7/2015 Romanov
9,091,444 B2 7/2015 Turrini et al.
9,127,549 B2 9/2015 Lacy et al.
9,175,855 B2 * 11/2015 Wegerif ..... F23R 3/04
9,249,671 B2 2/2016 Butler
9,322,560 B2 * 4/2016 Erbas-Sen ..... F23R 3/04
9,335,050 B2 5/2016 Cunha et al.
9,377,192 B2 6/2016 Hirata et al.
9,388,985 B2 7/2016 Wu et al.
9,416,973 B2 8/2016 Melton et al.
9,423,137 B2 8/2016 Nickolaus
2003/0101729 A1 6/2003 Srinivasan
2004/0103668 A1 6/2004 Bibler et al.
2007/0245742 A1 * 10/2007 Dahlke ..... F02K 1/82 60/754
2010/0300106 A1 * 12/2010 Edwards ..... F23R 3/10 60/752
2011/0016871 A1 1/2011 Kraemer et al.
2011/0083439 A1 4/2011 Zuo et al.
2011/0252803 A1 10/2011 Subramanian et al.
2012/0096866 A1 4/2012 Khan et al.
2012/0131923 A1 5/2012 Elkady et al.
2012/0285173 A1 11/2012 Poyyapakkam et al.
2013/0042625 A1 2/2013 Barker et al.
2013/0199188 A1 8/2013 Boardman et al.
2013/0239581 A1 9/2013 Johnson et al.
2013/0336759 A1 12/2013 Christians
2014/0060060 A1 3/2014 Bernero et al.
2014/0290258 A1 10/2014 Gerendas et al.
2015/0033746 A1 * 2/2015 Carey ..... F02C 7/24 60/752
2015/0076251 A1 3/2015 Berry
2015/0128607 A1 5/2015 Lee
2015/0159875 A1 6/2015 Berry et al.
2015/0241064 A1 * 8/2015 Boardman ..... F23R 3/283 60/737
2015/0354818 A1 * 12/2015 Lebel ..... F23R 3/002 60/796
2016/0010856 A1 1/2016 Biagioli et al.
2016/0054004 A1 * 2/2016 Stoia ..... F02C 7/18 60/806
2016/0131363 A1 * 5/2016 Cunha ..... F16C 29/02 60/755
2016/0169110 A1 6/2016 Myers et al.
2016/0209036 A1 7/2016 Cheung
2016/0298841 A1 * 10/2016 Papple ..... F23R 3/005
2016/0298848 A1 10/2016 Geary et al.
2018/0100652 A1 * 4/2018 Vranjic ..... F23R 3/28
2018/0128488 A1 5/2018 Boardman et al.

OTHER PUBLICATIONS

Snyder et al., Emission and Performance of a Lean-Premixed Gas Fuel Injection System for Aeroderivative Gas Turbine Engines, Journal of Engineering for Gas Turbines and Power, ASME Digital Collection, vol. 118, Issue 1, Jan. 1, 1996, pp. 38-45.

Srinivasan et al., Improving low load combustion, stability, and emissions in pilot-ignited natural gas engines, Journal of Automo-

(56) References Cited

OTHER PUBLICATIONS bile Engineering, Sage Journals, vol. 220, No. 2, Feb. 1, 2006, pp. 229-239.
Chinese Office Action Corresponding to Application No. 2201780082651 dated Mar. 3, 2020.

* cited by examiner

FUEL NOZZLE ASSEMBLY WITH MICRO CHANNEL COOLING

FIELD

The present subject matter relates generally to gas turbine engine combustion assemblies. More particularly, the present subject matter relates to a fuel nozzle and combustor assembly for gas turbine engines.

BACKGROUND

Aircraft and industrial gas turbine engines include a combustor in which fuel is burned to input energy to the engine cycle. Typical combustors incorporate one or more fuel nozzles whose function is to introduce liquid or gaseous fuel into an air flow stream so that it can atomize and burn. General gas turbine engine combustion design criteria include optimizing the mixture and combustion of a fuel and air to produce high-energy combustion.

However, producing high-energy combustion often produces conflicting and adverse results that must be resolved. For example, high-energy combustion often results in high temperatures that require cooling air to mitigate wear and degradation of combustor assembly components. However, utilizing cooling air to mitigate wear and degradation of combustor assembly components may reduce combustion and overall gas turbine engine efficiency.

Therefore, a need exists for a fuel nozzle assembly that may produce high-energy combustion while minimizing structural wear and degradation and mitigating combustion and overall gas turbine engine efficiency loss.

BRIEF DESCRIPTION

Aspects and advantages of the invention will be set forth in part in the following description, or may be obvious from the description, or may be learned through practice of the invention.

The present disclosure is directed to a fuel nozzle for a gas turbine engine, the fuel nozzle defining a radial direction, a longitudinal direction, a circumferential direction, an upstream end, and a downstream end. The fuel nozzle includes an aft body coupled to at least one fuel injector. The aft body defines a forward wall and an aft wall each extended in the radial direction, and a plurality of sidewalls extended in the longitudinal direction. The plurality of sidewalls couples the forward wall and the aft wall. The forward wall defines at least one channel inlet orifice. At least one sidewall defines at least one channel outlet orifice. At least one micro channel cooling circuit is defined between the one or more channel inlet orifices and the one or more channel outlet orifices.

Another aspect of the present disclosure is directed to a combustor assembly for a gas turbine engine, the combustor assembly defining a radial direction, a longitudinal direction, a circumferential direction, an upstream end, and a downstream end. The combustor assembly includes a bulkhead and one or more of a fuel nozzle assembly. Each fuel nozzle assembly includes at least one fuel injector and an aft body coupled to at least one fuel injector. The aft body defines a forward wall and an aft wall each extended in the radial direction, and a plurality of sidewalls extended in the longitudinal direction. The plurality of sidewalls couples the forward wall and the aft wall. The forward wall defines at least one channel inlet orifice. At least one sidewall defines at least one channel outlet orifice. At least one micro channel cooling circuit is defined between the one or more channel inlet orifices and the one or more channel outlet orifices. The bulkhead includes a wall extended in the radial direction, the longitudinal direction, and in a circumferential direction. The wall defines an aft face, a forward face, and a longitudinal portion therebetween. The longitudinal portion of the wall is adjacent to the one or more channel outlet orifices.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Figure 1:
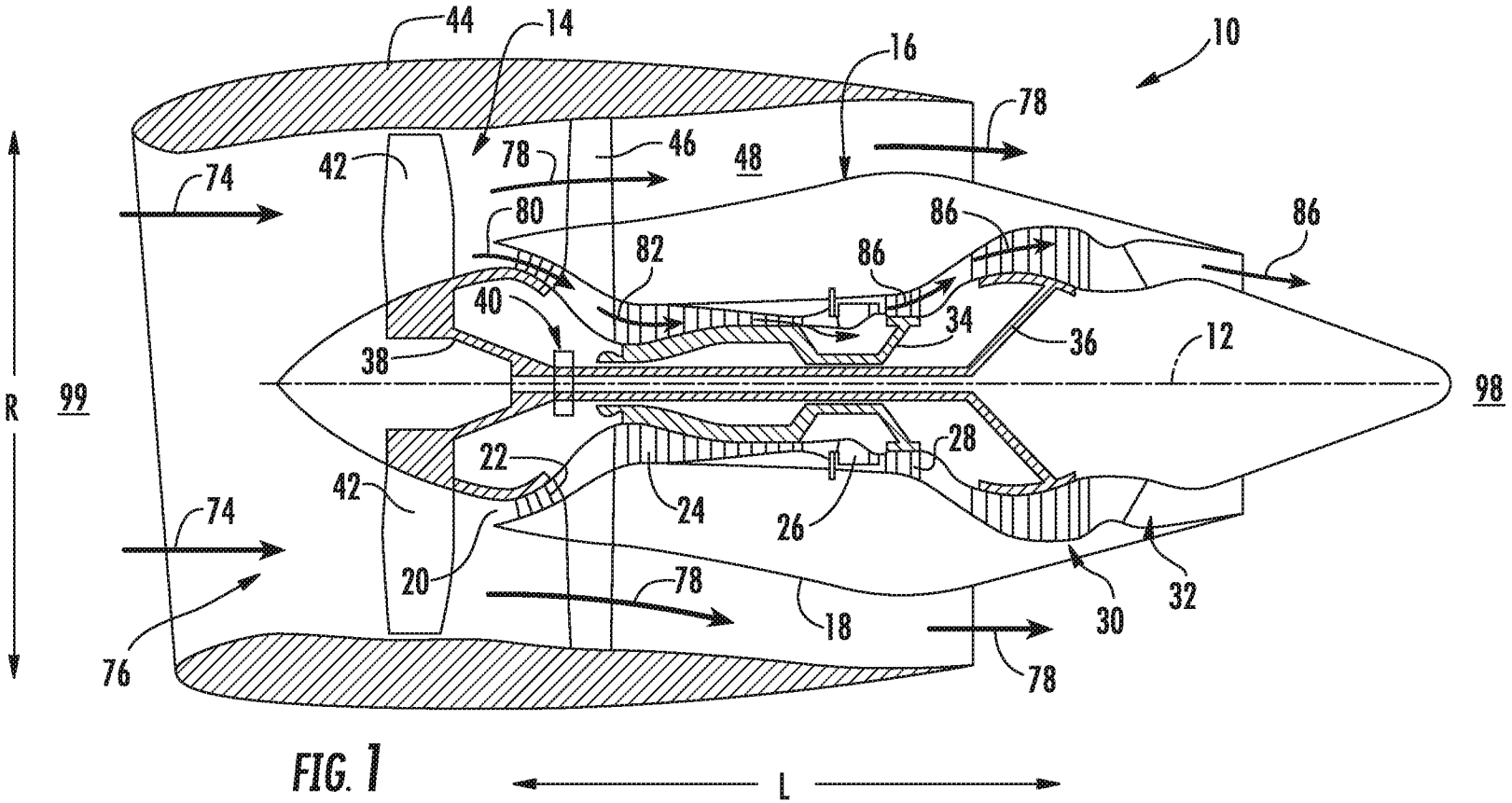
FIG. 1 is a partial schematic cross sectional view of an exemplary gas turbine engine incorporating an exemplary embodiment of a fuel nozzle and combustor assembly.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first", "second", and "third" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

Embodiments of a fuel nozzle and combustor assembly with micro channel cooling are generally provided. The embodiments provided generally herein may provide thermal management to the fuel nozzle while minimizing a quantity of compressed air utilized for thermal management, thereby mitigating combustion and overall gas turbine engine efficiency loss. For example, one or more micro channel cooling circuits may provide tailored thermal management to an aft body of each fuel nozzle that is adjacent to a combustion chamber and hot gases therein. The one or more micro channel cooling circuits may reduce temperatures and thermal gradients across the aft body of each fuel nozzle, thereby improving structural performance of each fuel nozzle while minimizing a quantity of compressed air utilized for cooling rather than combustion.

In various embodiments, the compressed air utilized for thermal management of the fuel nozzle is additionally utilized to provide thermal management to a combustor bulkhead. In still other embodiments, the combustor assembly provides cooling air to the fuel nozzle(s) and bulkhead while minimizing compressed air usage and providing high-energy combustion. For example, cooling air provided from the fuel nozzle, or, more specifically, an aft body of the fuel nozzle through one or more micro channel cooling circuits may define a boundary layer cooling fluid between the bulkhead and combustion gases in a combustion chamber.

Referring now to the drawings, FIG. 1 is a schematic partially cross-sectioned side view of an exemplary high by-pass turbofan jet engine 10 herein referred to as "engine 10" as may incorporate various embodiments of the present disclosure. Although further described below with reference to a turbofan engine, the present disclosure is also applicable to turbomachinery in general, including turbojet, turboprop, and turboshaft gas turbine engines, including marine and industrial turbine engines and auxiliary power units. As shown in FIG. 1, the engine 10 has a longitudinal or axial centerline axis 12 that extends there through for reference purposes. The engine 10 further defines a radial direction R, a longitudinal direction L, an upstream end 99, and a downstream end 98. In general, the engine 10 may include a fan assembly 14 and a core engine 16 disposed downstream from the fan assembly 14.

The core engine 16 may generally include a substantially tubular outer casing 18 that defines an annular inlet 20. The outer casing 18 encases or at least partially forms, in serial flow relationship, a compressor section having a booster or low pressure (LP) compressor 22, a high pressure (HP) compressor 24, a combustion section 26, a turbine section including a high pressure (HP) turbine 28, a low pressure (LP) turbine 30 and a jet exhaust nozzle section 32. A high pressure (HP) rotor shaft 34 drivingly connects the HP turbine 28 to the HP compressor 24. A low pressure (LP) rotor shaft 36 drivingly connects the LP turbine 30 to the LP compressor 22. The LP rotor shaft 36 may also be connected to a fan shaft 38 of the fan assembly 14. In particular embodiments, as shown in FIG. 1, the LP rotor shaft 36 may be connected to the fan shaft 38 by way of a reduction gear 40 such as in an indirect-drive or geared-drive configuration. In other embodiments, the engine 10 may further include an intermediate pressure (IP) compressor and turbine rotatable with an intermediate pressure shaft.

As shown in FIG. 1, the fan assembly 14 includes a plurality of fan blades 42 that are coupled to and that extend radially outwardly from the fan shaft 38. An annular fan casing or nacelle 44 circumferentially surrounds the fan assembly 14 and/or at least a portion of the core engine 16. In one embodiment, the nacelle 44 may be supported relative to the core engine 16 by a plurality of circumferentially-spaced outlet guide vanes or struts 46. Moreover, at least a portion of the nacelle 44 may extend over an outer portion of the core engine 16 so as to define a bypass airflow passage 48 therebetween.

Figure 2:
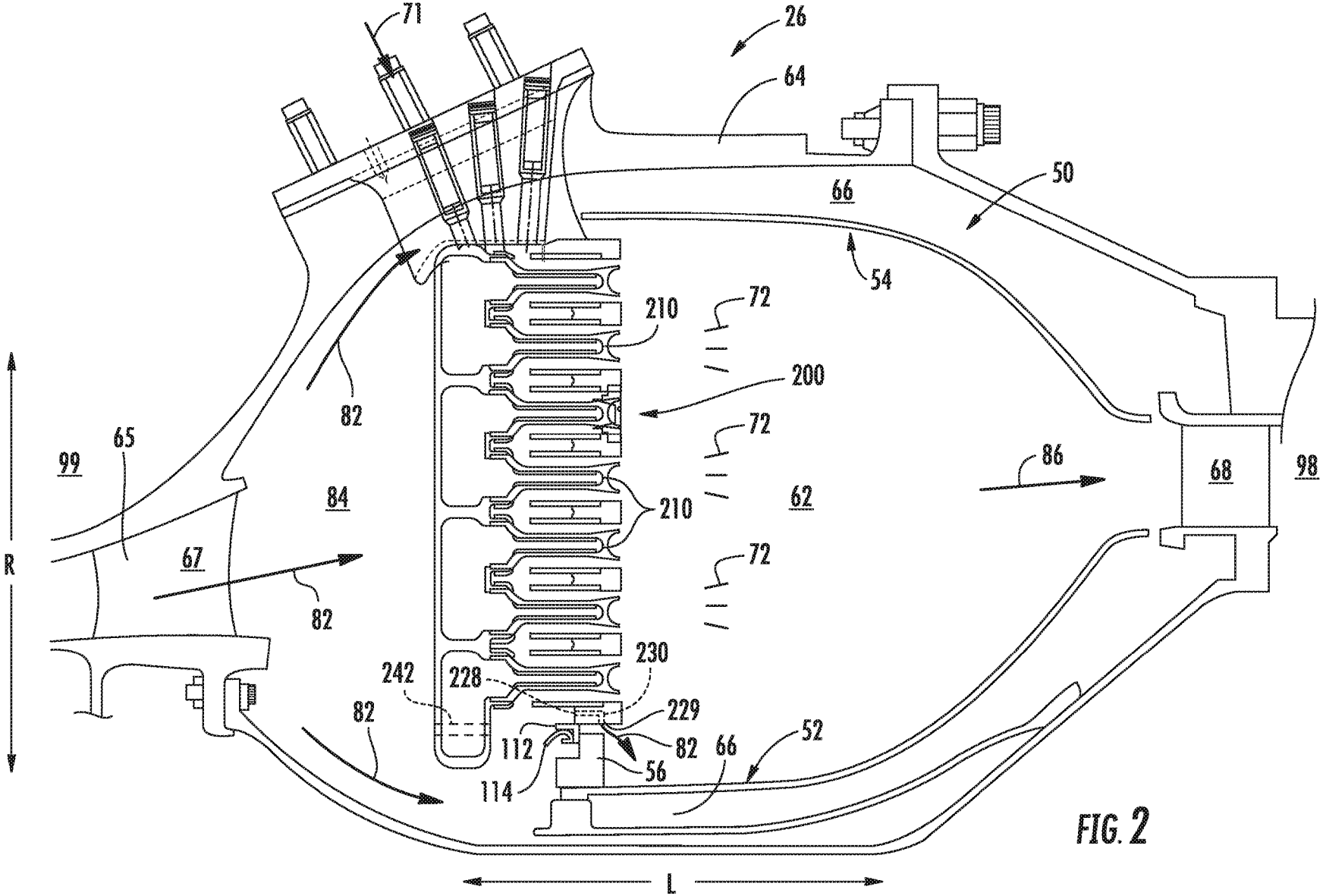
FIG. 2 is an axial cross sectional view of an exemplary embodiment of a combustor assembly of the exemplary engine shown in FIG. 1.

FIG. 2 is a cross sectional side view of an exemplary combustion section 26 of the core engine 16 as shown in FIG. 1. As shown in FIG. 2, the combustion section 26 may generally include an annular type combustor assembly 50 having an annular inner liner 52, an annular outer liner 54 and a bulkhead 56, in which the bulkhead 56 extends radially between the inner liner 52 and the outer liner 54, respectfully, at the upstream end 99 of each liner 52, 54. In other embodiments of the combustion section 26, the combustor assembly 50 may be a can or can-annular type. As shown in FIG. 2, the inner liner 52 is radially spaced from the outer liner 54 with respect to engine centerline 12 (FIG. 1) and defines a generally annular combustion chamber 62 therebetween. In particular embodiments, the inner liner 52 and/or the outer liner 54 may be at least partially or entirely formed from metal alloys or ceramic matrix composite (CMC) materials.

As shown in FIG. 2, the inner liner 52 and the outer liner 54 may be encased within an outer casing 64. An outer flow passage 66 may be defined around the inner liner 52 and/or the outer liner 54. The inner liner 52 and the outer liner 54 may extend along longitudinal direction L from the bulkhead 56 towards a turbine nozzle or inlet 68 to the HP turbine 28 (FIG. 1), thus at least partially defining a hot gas path between the combustor assembly 50 and the HP turbine 28.

Figure 3:
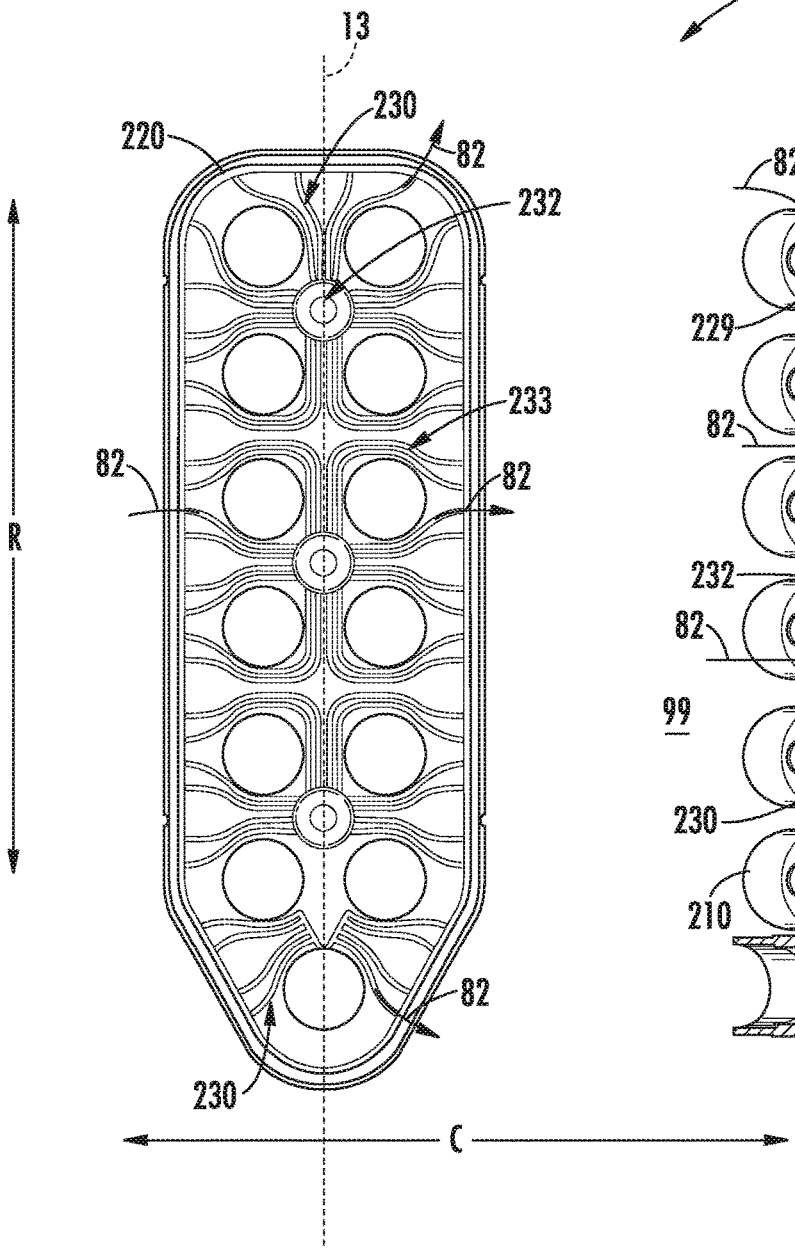
FIG. 3 is a radial cutaway view of an exemplary embodiment of the fuel nozzle is shown.
Figure 4:
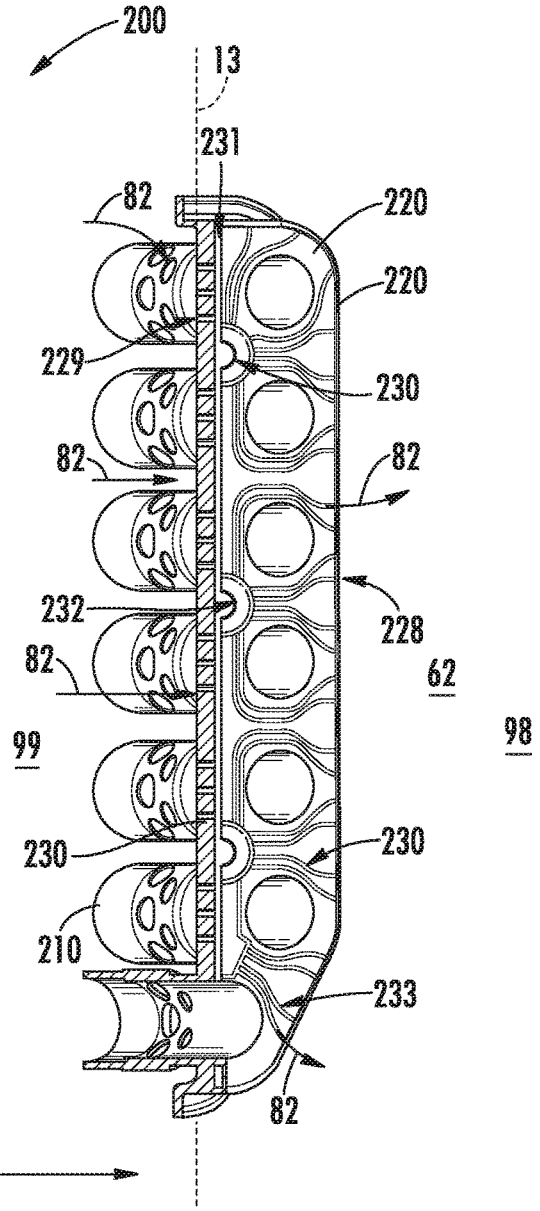
FIG. 4 is a cutaway perspective view of the fuel nozzle shown in FIG. 3 cut along a radial centerline.
Figure 5:
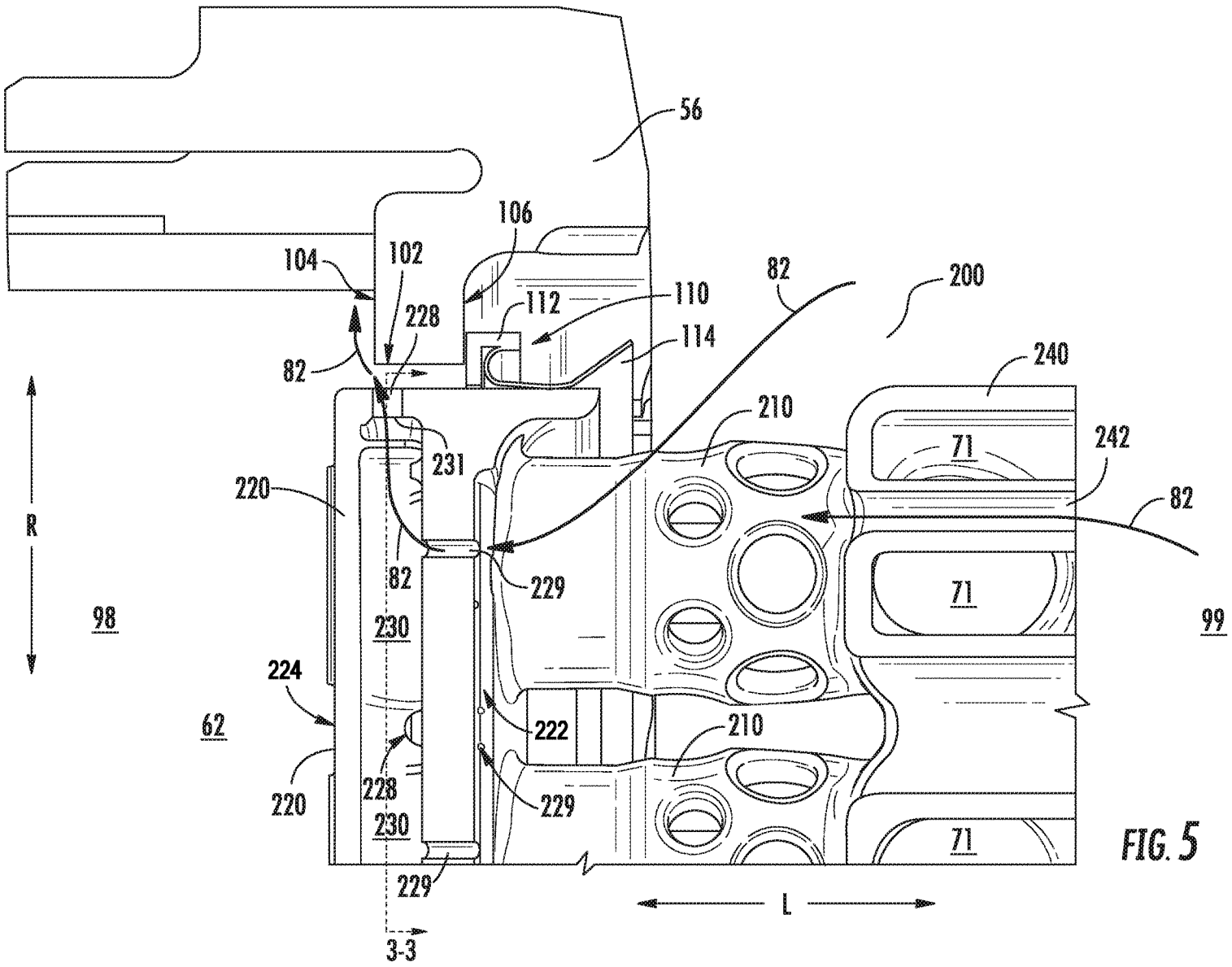
FIG. 5 is an axial cross sectional view of an exemplary embodiment of a fuel nozzle and bulkhead of a combustor assembly.

Referring now to FIG. 3, a radial cutaway view of an exemplary embodiment of the fuel nozzle 200 is generally provided at section 3-3 as shown in FIG. 5. Referring also to FIG. 4, a cutaway perspective view of the fuel nozzle 200 shown in FIG. 3 along a radial centerline 13 extended from the axial centerline 12 is generally provided (i.e. showing the cutaway at section 3-3 and cutaway along the radial centerline 13). Referring to FIGS. 3 and 4, the fuel nozzle 200 defines a radial direction R, a longitudinal direction L, and a circumferential direction C. The fuel nozzle 200 includes an aft body 220 coupled to at least one fuel injector 210. The aft body 220 defines a forward wall 222 and an aft wall 224 each extended in the radial direction R. The aft body 220 further defines a plurality of sidewalls 226 (shown in FIG. 6) extended in the longitudinal direction L. The plurality of sidewalls 226 couples the forward wall 222 and the aft wall 224. The forward wall 222 defines at least one channel inlet orifice 229. At least one sidewall 226 defines at least one channel outlet orifice 228. At least one micro channel cooling circuit 230 is defined between the one or more channel inlet orifices 229 and the one or more channel outlet orifices 228.

Referring still to FIGS. 3 and 4, in various embodiments, the aft body 220 may further define one or more cooling cavities 231 between the forward wall 222, the aft wall 224, and the plurality of sidewalls 226. In one embodiment, as shown in FIGS. 3 and 4, the one or more cooling cavities 231 extends at least partially along the radial centerline 13 extended approximately symmetrically through each fuel nozzle 200 along the radial direction R. In other embodiments, one or more of the cooling cavities 231 may extend symmetrically along or beside the radial centerline 13.

In the embodiments shown in FIGS. 3 and 4, the one or more cooling cavities 231 is disposed between a plurality of fuel injectors 210 along the radial direction R and/or the circumferential direction C. For example, as shown in FIGS. 3 and 4, the cooling cavity 231 extends generally along the radial direction R between the fuel injectors 210 and in generally symmetric alignment therebetween.

In various embodiments, the aft body 220 further defines one or more cooling collectors 232 along the micro channel cooling circuit 230. Each cooling collector 232 defines a substantially cylindrical volume within the aft body 220 and disposed between a plurality of fuel injectors 210 along the radial direction R and/or the circumferential direction C. The one or more cooling collectors 232 define a volume at which a pressure and/or flow of compressed air 82 from the one or more compressors 22, 24 may normalize before continuing through the micro channel cooling circuit 230 and egressing through the one or more channel outlet orifices 228. In one embodiment, as shown in FIGS. 3 and 4, at least one of the cooling collectors 232 is disposed along the radial centerline 13 and in fluid communication with one or more of the cooling cavities 231.

In one embodiment, as shown in FIGS. 3 and 4, one or more of the micro channel cooling circuits 230 defines a serpentine passage 233 within the aft body 220. The serpentine passage 233 may extend at least partially along the circumferential direction C and at least partially along the radial direction R. In various embodiments, the serpentine passage 233 may extend at least partially along the longitudinal direction L, the radial direction R, and/or the circumferential direction C. In one embodiment of the micro channel cooling circuit 230 shown in FIGS. 3 and 4, at least one of the micro channel cooling circuits 230 extends at least partially circumferentially around one or more of the fuel injectors 210.

In each of the various embodiments, the micro channel cooling circuit 230, including one or more cooling cavities 231 and/or one or more cooling collectors 232 may provide substantially uniform or even pressure and/or flow distribution from the channel inlet orifice 229 and through a plurality of the channel outlet orifices 228. In other embodiments, the micro channel cooling circuit 230 may provide substantially uniform or even pressure/and or flow distribution from the one or more cooling collectors 232 through a plurality of the channel outlet orifices 228. In providing a substantially even pressure and/or flow distribution, each micro channel cooling circuit 230 may provide substantially similar and/or even heat transfer over the aft body 220 of the fuel nozzle 200. The substantially similar and/or even heat transfer over the aft body 220 may reduce a thermal gradient of the aft body 220 along the radial direction R, the longitudinal direction L, and/or the circumferential direction C.

In various embodiments, each micro channel cooling circuit 230 may define a first diameter, area, and/or volume different from a second diameter, area, and/or volume relative to another channel inlet orifice 229, micro channel cooling circuit 230, or channel outlet orifice 228, respectively. Defining the first diameter, area, and/or volume different from the second diameter, area, and/or volume may tailor or otherwise influence heat transfer through the aft body 220. For example, the first diameter, area, and/or volume may be disposed to higher temperature or thermal gradient portions of the aft body 220 in contrast to the second diameter, area, and/or volume disposed to lower temperature or thermal gradient portions. As such, the fuel nozzle 200 may define one or more micro channel cooling circuits 230 such that an asymmetric pressure and/or flow is defined therethrough. Still further, the fuel nozzle 200 may define one or more micro channel cooling circuits 230 to impart an asymmetric heat transfer tailored to specific portions of the aft body 220. For example, the serpentine passages 233 of the micro channel cooling circuits 230 may extend at least partially circumferentially around each fuel injector 210 to reduce a temperature of the aft body 220 proximate to the downstream end 98 of each fuel injector 210 proximate to a flame emitting therefrom.

Referring now to FIG. 5, a side view of another exemplary embodiment of the fuel nozzle 200 and the bulkhead 56 are generally provided. The fuel nozzle 200 may further include a forward body 240 coupled to the upstream end 99 of each fuel injector 210. The forward body 240 may define at least one air inlet orifice 242 extended in the longitudinal direction L. In various embodiments, the at least one air inlet orifice 242 may extend along the radial direction R and/or circumferential direction C and the longitudinal direction L. In still other embodiments, the air inlet orifice 242 may define a serpentine passage within the forward body 240.

The various embodiments of the fuel nozzle 200, the channel inlet orifice 229, micro channel cooling circuit 230, channel outlet orifice 228, and air inlet orifice 242 together may provide thermal management that may improve structural performance of the fuel nozzle 200. The various embodiments may also provide thermal management benefits to the fuel 71 within the fuel nozzle 200, such as by desirably altering physical properties of the fuel 71 to aid combustion or prevent fuel coking within the fuel nozzle 200.

Referring back to FIGS. 1-5, during operation of the engine 10 a volume of air as indicated schematically by arrows 74 enters the engine 10 through an associated inlet 76 of the nacelle 44 and/or fan assembly 14. As the air 74 passes across the fan blades 42 a portion of the air as indicated schematically by arrows 78 is directed or routed into the bypass airflow passage 48 while another portion of the air as indicated schematically by arrow 80 is directed or routed into the LP compressor 22. Air 80 is progressively compressed as it flows through the LP and HP compressors 22, 24 towards the combustion section 26. As shown in FIG. 2, the now compressed air as indicated schematically by arrows 82 flows across a compressor exit guide vane (CEGV) 67 as a component of a prediffuser 65 into a diffuser cavity or head end portion 84 of the combustion section 26.

The compressed air 82 pressurizes the diffuser cavity 84. The prediffuser 65 generally, and, in various embodiments, the CEGV 67 more particularly, condition the flow of compressed air 82 to the fuel nozzle 200. In various embodiments, the prediffuser 65 and/or CEGV 67 direct the compressed air 82 to one or more air inlet orifices 242 (shown in FIG. 7) defined in the forward body 240 of each fuel nozzle 200.

Additionally, the compressed air 82 enters the fuel nozzle 200 and into the one or more fuel injectors 210 within the fuel nozzle 200 to mix with a fuel 71. In one embodiment, each fuel injector 210 premixes fuel 71 and air 82 within the array of fuel injectors 210 with little or no swirl to the resulting fuel-air mixture 72 exiting the fuel nozzle 200. After premixing the fuel 71 and air 82 within the fuel injectors 210, the fuel-air mixture 72 burns from each of the plurality of fuel injectors 210 as an array of compact, tubular flames stabilized from each fuel injector 210.

The LP and HP compressors 22, 24 may provide compressed air 82 for thermal management of at least a portion of the combustion section 26 and/or the turbine section 31 in addition to combustion. For example, as shown in FIG. 2, compressed air 82 may be routed into the outer flow passage 66 to provide cooling to the inner and outer liners 52, 54. As another example, at least a portion of the compressed air 82 may be routed out of the diffuser cavity 84. As still another example, the compressed air 82 may be directed through various flow passages to provide cooling air to at least one of the HP turbine 28 or the LP turbine 30.

Referring back to FIGS. 1 and 2 collectively, the combustion gases 86 generated in the combustion chamber 62 flow from the combustor assembly 50 into the HP turbine 28, thus causing the HP rotor shaft 34 to rotate, thereby supporting operation of the HP compressor 24. As shown in FIG. 1, the combustion gases 86 are then routed through the LP turbine 30, thus causing the LP rotor shaft 36 to rotate, thereby supporting operation of the LP compressor 22 and/or rotation of the fan shaft 38. The combustion gases 86 are then exhausted through the jet exhaust nozzle section 32 of the core engine 16 to provide propulsive thrust.

Referring now to FIG. 5, an exemplary embodiment of the fuel nozzle 200 and the bulkhead 56 of the combustor assembly 50 of the engine 10 is provided. Referring now to FIGS. 1-6, the bulkhead 56 includes a wall 100 extended along the radial direction R, the longitudinal direction L, and in a circumferential direction C (not shown in FIGS. 1 and 2). The wall 100 defines an aft face 104, a forward face 106, and a longitudinal portion 102 therebetween. The longitudinal portion 102 of the wall 100 is adjacent to the plurality of sidewalls 226 of each fuel nozzle 200. In one embodiment, the longitudinal portion 102 of the wall 100 is adjacent to the channel outlet orifice 228 of the fuel nozzle 200 in the radial direction R.

Referring to FIGS. 1-5, the bulkhead 56 further includes an annular seal ring 110 extended in the circumferential direction. The seal ring 110 is disposed upstream of the bulkhead 56. The seal ring 110 is further disposed outward and/or inward of the fuel nozzle(s) 200 along the radial direction R. The seal ring 110 defines a first seal 112 adjacent to the forward face 106 of the wall 100 of the bulkhead 56. The seal ring 110 further defines a second seal 114 adjacent to the first seal 112. In various embodiments, the second seal 114 may further define a flared lip 116 extended at least partially in the radial direction R and the longitudinal direction L toward the upstream end 99. In one embodiment of the seal ring 110, compressed air 82 applies a force onto the seal ring 110 toward the downstream end 98 to form a seal such that little or no fluid communication occurs between the diffuser cavity 84 and the combustion chamber 62. In another embodiment of the seal ring 110, the flared lip 116 increases an area that the compressed air 82 may apply force onto the seal ring 110 to augment the seal between the diffuser cavity 84 and the combustion chamber 62.

In one embodiment of the combustor assembly 50 shown in FIGS. 1-5, the compressed air 82 enters the fuel nozzle 200 through one or more air inlet orifices 242 defined in the forward body 240 of the fuel nozzle 200. The compressed air 82 may flow through the forward body 240 of the fuel nozzle to provide air for the one or more fuel injectors 210 of the fuel nozzle 200. In various embodiments, the compressed air 82 may provide thermal energy transfer between the fuel 71 within the forward body 240 of the fuel nozzle 200 and the compressed air 82. For example, in one embodiment of the engine 10, the fuel 71 may receive thermal energy from the compressed air 82. The added thermal energy to the fuel 71 may reduce viscosity and promote fuel atomization with compressed air 82 for combustion.

In another embodiment, the compressed air 82 flows through the forward body 240 to the one or more channel inlet orifices 229 in the aft body 220. In still other embodiments, the compressed air 82 may direct around, above, and/or below (in the radial direction R) the forward body 240 to enter the fuel nozzle 200 through one or more channel inlet orifices 229 defined in the aft body 220 of the fuel nozzle 200. The compressed air 82 may flow through the one or more channel inlet orifices 229 into and through the micro channel cooling circuit 230. In the embodiment shown in FIG. 5, the compressed air 82 exits the channel outlet orifice 228 in fluid and thermal communication with the bulkhead 56. More specifically, the compressed air 82 may exit the channel outlet orifice 228 in fluid and thermal communication with the longitudinal portion 102 of the wall 100 of the bulkhead 56 adjacent to the channel outlet orifice 228 (as shown in FIG. 5).

Figure 6:
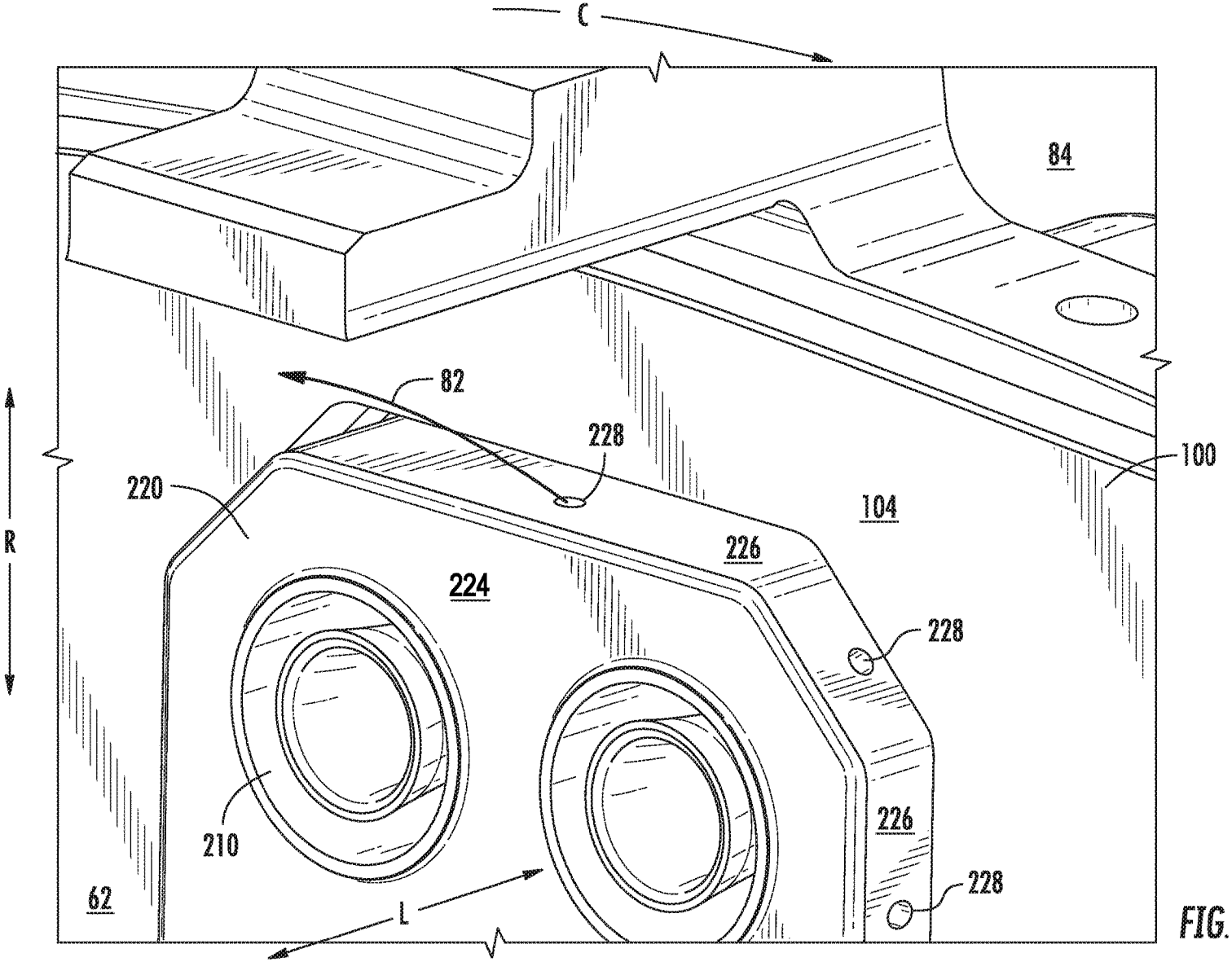
FIG. 6 is a perspective view of an exemplary embodiment of a fuel nozzle and bulkhead of a combustor assembly.

Referring now to FIG. 6, a perspective view of a portion of the combustor assembly 50 is shown. In the embodiment shown in FIG. 6, the channel outlet orifice 228 is disposed downstream of the wall 100 of the bulkhead 56. In one embodiment, the channel outlet orifice 228 may be defined downstream of the wall 100 of the bulkhead 56. In another embodiment, the channel outlet orifice 228 may be defined downstream of the wall 100 and proximate to the aft face 104 of the wall 100 such that the compressed air 82 is in fluid and thermal communication with the aft face 104 from channel outlet orifice 228. Defining the channel outlet orifice 228 downstream of the wall 100 of the bulkhead 56 may affect flow and temperature at or near the wall 100 by defining a boundary layer film or buffer of cooler compressed air 82 between the wall 100 and the combustion gases 86 in the combustion chamber 62.

Referring now to FIGS. 1-6, in other embodiments, the fuel nozzle 200 may include structure such as a rigid or flexible tube to feed a cooling fluid through the micro channel cooling circuit 230. The cooling fluid may work alternatively to the compressed air 82 through one or more of the air inlet orifice 242, channel inlet orifice 229, and/or the micro channel cooling circuit 230 to provide thermal communication and thermal management to the fuel nozzle 200, or the aft body 220 and the bulkhead 56. For example, the cooling fluid may be an inert gas. As another example, the cooling fluid may be air from another source, such as an external engine apparatus, or from other locations from the compressors 22, 24 (e.g. bleed air).

Figure 7:
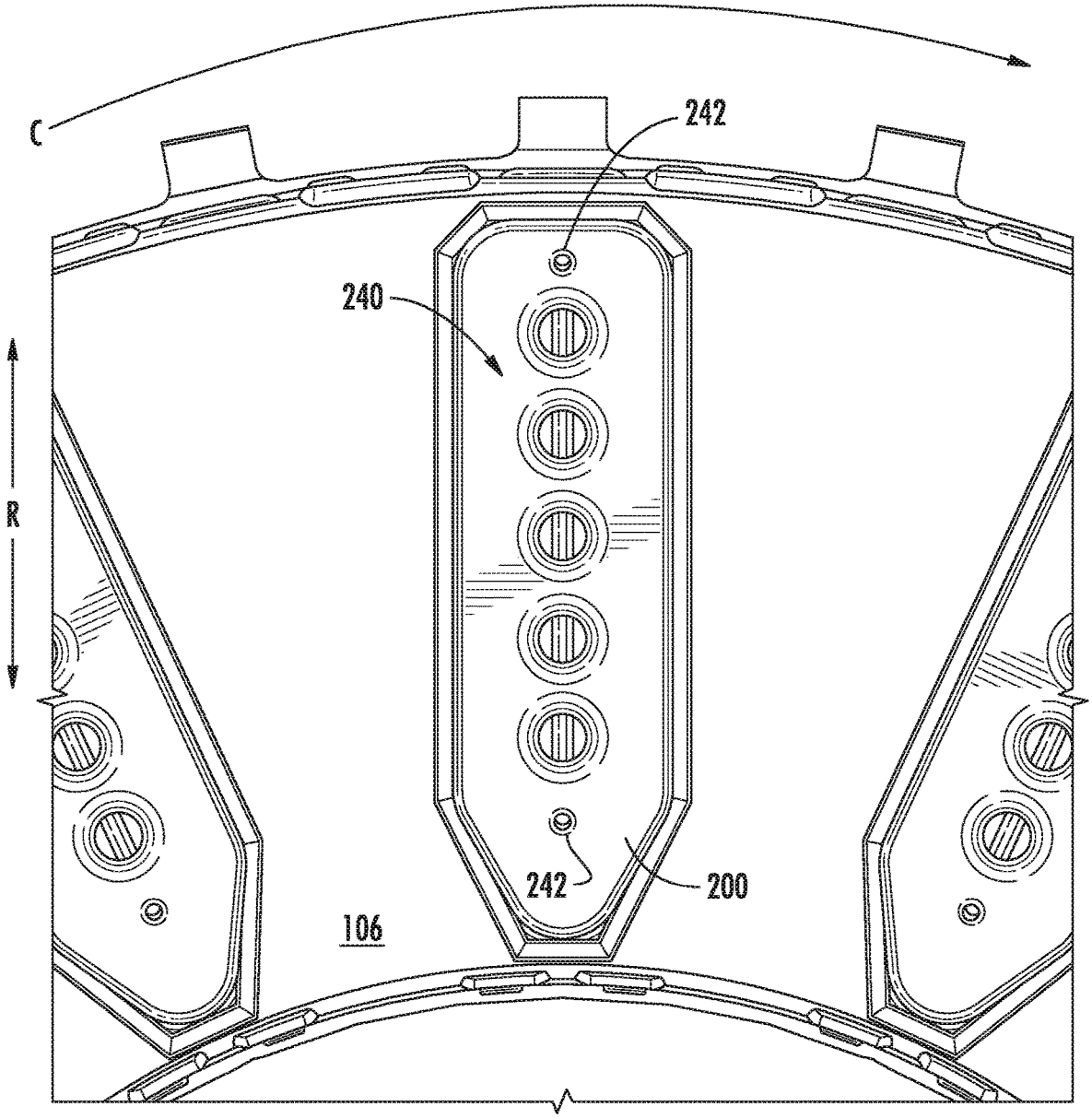
FIG. 7 is an upstream view of the exemplary embodiment of the fuel nozzle and bulkhead shown in FIG. 6.

Referring now to FIG. 7, an exemplary embodiment of the fuel nozzle 200 is shown from upstream viewed toward downstream. The embodiment shown in FIG. 7 show a portion of the bulkhead 56, the forward body 240 of the fuel nozzle 200, and at least one air inlet orifice 242. The embodiment in FIG. 7 further shows a plurality of air inlet passages 244 defined in the forward body 240 to feed compressed air 82 to one or more fuel injectors 100 and/or at least one channel inlet orifice 229 (not shown in FIG. 7).

The fuel nozzle 200 and combustor assembly 50 shown in FIGS. 1-7 and described herein may be constructed as an assembly of various components that are mechanically joined or as a single, unitary component and manufactured from any number of processes commonly known by one skilled in the art. These manufacturing processes include, but are not limited to, those referred to as "additive manufacturing" or 3D printing". Additionally, any number of casting, machining, welding, brazing, or sintering processes, or mechanical fasteners, or any combination thereof, may be utilized to construct the fuel nozzle 200 or the combustor assembly 50. Furthermore, the fuel nozzle 200 and the combustor assembly 50 may be constructed of any suitable material for turbine engine combustion sections, including but not limited to, nickel- and cobalt-based alloys. Still further, flowpath surfaces may include surface finishing or other manufacturing methods to reduce drag or otherwise promote fluid flow, such as, but not limited to, tumble finishing, barreling, rifling, polishing, or coating.

Embodiments of the fuel nozzle 200 and the combustor assembly 50 with micro channel cooling circuits 230 generally provided herein may provide thermal management to the fuel nozzle 200 while minimizing a quantity of compressed air 82 utilized for thermal management, thereby increasing combustion and gas turbine engine efficiency. For example, one or more micro channel cooling circuits 230 may provide tailored thermal management to the aft body 220 of each fuel nozzle 200 that is adjacent to the combustion chamber 62 and hot combustion gases 86 therein. The one or more micro channel cooling circuits 230 may reduce temperatures and thermal gradients across the aft body 220 of each fuel nozzle 200, thereby improving structural performance of each fuel nozzle 200 while minimizing the quantity of compressed air 82 utilized for cooling rather than combustion.

In various embodiments, the compressed air 82 utilized for thermal management of the fuel nozzle 200 is additionally utilized to provide thermal management to the combustor bulkhead 56. In still other embodiments, the combustor assembly 50 provides cooling air to the fuel nozzle(s) 200 and bulkhead 56 while minimizing compressed air 82 usage and providing high-energy combustion. For example, cooling air, such as compressed air 82, provided from the fuel nozzle 200, or, more specifically, the aft body 220 of the fuel nozzle 200 through one or more micro channel cooling circuits 230 may define a boundary layer cooling fluid between the bulkhead 56 and combustion gases 86 in the combustion chamber 82.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A fuel nozzle for a gas turbine engine, the fuel nozzle defining a radial direction, a longitudinal direction, a circumferential direction, an upstream end, and a downstream end, the fuel nozzle comprising:

an aft body coupled to at least one fuel injector, wherein the aft body defines a forward wall and an aft wall each extended in the radial direction, and a of sidewall extended in the longitudinal direction, wherein the sidewall couples the forward wall and the aft wall, wherein the forward wall defines a plurality of channel inlet orifices, and wherein the sidewall defines a plurality of channel outlet orifices, further wherein a plurality of distinct passages is defined through the aft body between the forward wall and aft wall, and wherein each of the distinct passages is configured to convey oxidizer to a respective channel outlet orifice from at least one of the channel inlet orifices.

2. The fuel nozzle of claim 1, wherein the forward wall defines at least one of the channel inlet orifices at least partially along the longitudinal direction.

3. The fuel nozzle of claim 2, wherein the forward wall defines at least one of the channel inlet orifices approximately along a radial centerline of the fuel nozzle.

4. The fuel nozzle of claim 1, wherein the aft body further defines one or more cooling cavities between the forward wall, the aft wall, and the sidewall.

5. The fuel nozzle of claim 4, wherein the one or more cooling cavities extends at least partially along a radial centerline of the fuel nozzle.

6. The fuel nozzle of claim 4, wherein the one or more cooling cavities is disposed between a plurality of fuel injectors along the radial and/or circumferential directions.

7. The fuel nozzle of claim 1, wherein one or more of the plurality of distinct passages defines a serpentine passage within the aft body.

8. The fuel nozzle of claim 1, wherein at least one of the distinct passages extends at least partially circumferentially around one or more fuel injectors.

9. The fuel nozzle of claim 1, wherein the aft body further defines one or more cooling collectors, wherein each cooling collector defines a substantially cylindrical volume within the aft body and disposed between a plurality of fuel injectors along the radial and/or circumferential direction.

10. The fuel nozzle of claim 9, wherein at least one of the cooling collectors is disposed along a radial centerline of the fuel nozzle and in fluid communication with one or more cooling cavities.

11. The fuel nozzle of claim 1, wherein the plurality of distinct passages each define a substantially uniform pressure distribution among one another between the at least one channel inlet orifice and the respective channel outlet orifice.

12. The fuel nozzle of claim 1, further comprising:

a forward body coupled to the upstream end of each fuel injector, wherein the forward body defines at least one air inlet orifice extended in the longitudinal direction.

13. A combustor assembly for a gas turbine engine, the combustor assembly defining a radial direction, a longitudinal direction, a circumferential direction, an upstream end, and a downstream end, the combustor assembly comprising:

a fuel nozzle assembly, wherein the fuel nozzle assembly includes at least one fuel injector and an aft body coupled to at least one fuel injector, wherein the aft body comprises a forward wall and an aft wall each extended in the radial direction, and a sidewall extended in the longitudinal direction, wherein the sidewall couples the forward wall and the aft wall, wherein the forward wall defines a plurality of channel inlet orifices, and wherein the sidewall defines a plurality of channel outlet orifices, further wherein a plurality of distinct passages is defined through the aft body between the forward wall and the aft wall, and wherein each of the distinct passages is configured to convey oxidizer to a respective channel outlet orifice from at least one of the channel inlet orifices; and a bulkhead including a wall extended in the radial direction, the longitudinal direction, and in a circumferential direction, wherein the wall comprises an aft face, a forward face, and a longitudinal portion therebetween, and wherein the longitudinal portion of the wall is adjacent to the plurality of channel outlet orifices.

14. The combustor assembly of claim 13, wherein the longitudinal portion of the wall of the bulkhead is adjacent to one or more of the plurality of channel outlet orifices in the radial and/or circumferential direction.

15. The combustor assembly of claim 14, wherein compressed air exits the plurality of channel outlet orifices in fluid and thermal communication with the longitudinal portion of the wall of the bulkhead.

16. The combustor assembly of claim 13, wherein one or more of the channel outlet orifices is defined downstream of the wall of the bulkhead.

17. The combustor assembly of claim 13, further comprising:

a seal ring, wherein the seal ring defines a first seal and a flared lip, wherein the first seal is adjacent to the forward face of the wall of the bulkhead and the flared lip extends at least partially in the radial direction and the longitudinal direction toward the upstream end.

18. The combustor assembly of claim 13, wherein one or more of the plurality of distinct passages defines a serpentine passage within the aft body.

19. The combustor assembly of claim 13, wherein the forward wall of the aft body defines at least one of the plurality of channel inlet orifices at least partially along the longitudinal direction.

20. The combustor assembly of claim 13, wherein the aft body further defines one or more cooling cavities between the forward wall, the aft wall, and the sidewall.

* * * * *